United States Patent [19]

Ko

[11] 4,424,913

[45] Jan. 10, 1984

[54] BEVERAGE CONTAINER WITH INTEGRAL STRAW

[76] Inventor: Duk H. Ko, 4526½ St. Elmo Dr., Los Angeles, Calif. 90019

[21] Appl. No.: 412,610

[22] Filed: Aug. 30, 1982

[51] Int. Cl.[3] ..... A47G 19/22; B65D 25/38

[52] U.S. Cl. ..... 220/90.2; 215/1 A; 229/7 S

[58] Field of Search ..... 220/90.2; 229/7 S; 215/1 A

[56] References Cited

U.S. PATENT DOCUMENTS

| | | | |
|---|---|---|---|
| 3,263,855 | 8/1966 | Push, Sr. | 220/90.2 X |
| 3,295,715 | 1/1967 | Push | 220/90.2 X |
| 3,656,654 | 4/1972 | Brinkley | 220/90.2 |
| 3,717,476 | 2/1973 | Harvey | 220/90.2 X |
| 4,078,692 | 3/1978 | Stein | 220/90.2 |
| 4,109,817 | 8/1978 | Payne et al. | 220/90.2 |
| 4,194,674 | 3/1980 | Pearson | 229/7 S |
| 4,226,356 | 10/1980 | Lemelson | 220/90.2 X |
| 4,228,913 | 10/1980 | Mack et al. | 220/90.2 |
| 4,305,521 | 12/1981 | Komatsuta | 220/90.2 |

*Primary Examiner*—Allan N. Shoap

*Attorney, Agent, or Firm*—Frank Frisenda, Jr.

[57] ABSTRACT

The invention provides an improved packaging system for beverages, the system comprising a beverage container having an integral straw permitting automatic emergence of the straw when a pull tab is separated from the container. In one embodied form, the flexible, resilient straw is held internally within the container by a retaining collar member which is suitably secured to the underside of the pull tab to hold the straw in a deformed condition when the pull tab is not yet separated from the container. In a preferred embodied form, the straw comprises an upper corrugated portion to permit prescribed resiliency and adjustment of length when internally positioned within the container. Accordingly, the present invention provides a unique convenient packaging system for beverages which enhances safety and hygienic features of conventional pull tab beverage containers at a relatively modest production cost.

7 Claims, 7 Drawing Figures

BEVERAGE CONTAINER WITH INTEGRAL STRAW

BACKGROUND OF THE INVENTION

Beverage containers for sodas, juices, fruit drinks, etc. of the type incorporating a pull tab and pull ring in a top portion of the container have, generally gained wide acceptance with the beverage industry and consumers alike. Typically, the ring is pulled to separate the tab from the container along a weakened seam to thereby provide access to the contained beverage. One means of drinking the beverage, of course, is to insert a straw in order to sip liquid therefrom. It is also a common practice to pour container contents into a glass for drinking.

Numerous improvements have been proposed and various modifications developed in which the container is provided with built-in straw by a variety of mechanisms including, for instance, a resilient bellows structure contained on the bottom of the can which serves to bias the top end of the straw against the underside of the pull tab top. In this connection, reference is made to the patent issued to Mack et al, U.S. Pat. No. 4,228,913 which disclosure is incorporated herein.

The Mack invention is stated to comprise a straw guide which aligns the top assembly of the straw against the underside of the tab top assembly. Further, the straw guide is used to secure the straw within the can so that the top end of the straw will not move around within the can and lose its alignment with the underside of the tab top assembly. The Mack straw has an integrally formed, resilient bellow structure for biasing the top end of the straw against the underside of the tab top so that the top end of the straw is ejected through the drinking slot formed when the tab top assembly is pulled off.

Payne in U.S. Pat. No. 4,109,817, suggests an alternative assembly wherein a collapsible straw is slideably journaled within a tube mounted on the wall of the container. The tube retains the straw in alignment with the container opening and the straw includes a float mounted on the straw adjacent its bottom end and being exterior of the tube. Thus, when the pull tab closure is opened, the straw rises within the tube because of the float until the upper portion of the straw projects through the opening above the top.

While the foregoing skilled artisans have recognized significant advantages of enhancing hygienic features of beverage containers and preventing cut lips of a drinker who sips directly from the pull tab slot, the developed modification has not generally been convenient to fabricate. This unfortunately results in a prohibitive cost in terms of incorporating such improvements into conventional beverage can designs.

Accordingly, those skilled in the art have recognized a significant need for an integral dispenser straw system for beverage cans which may be conveniently manufactured at modest cost, providing a mechanism which will be easily integrated with conventional beverage container structures and which can be fabricated in conventional production facilities. The present invention fulfills these needs.

SUMMARY OF THE INVENTION

This invention relates to an improved system for packaging beverages, for instance, of the type wherein a liquid beverage is packaged within a container having a pull tab opening. Briefly, and in general terms, the unique system comprises a container with an integral, flexible, resilient straw permitting automatic emergence of the straw from the container when the pull tab is separated from the container.

In more detail and in a presently preferred embodiment the inventive packaging system for beverages comprises a beverage container having, at a top portion, a pull tab and a pull ring; the pull tab and pull ring being joined by anchoring means; wherein when separated along the weakened seam the ring cooperates with the tab to produce a drinking opening in the container top portion;

an integral, flexible, resilient, tubular drinking straw disposed internally of the beverage container; and a resilient collar member disposed on the underside of the tab for holding the drinking straw in a deformed condition internally of the container when the pull tab is not separated from the container top portion;

the collar member comprising a top collar portion which is received and joined within a hollow disposed in the underside of the anchoring means, the collar member further comprising two resilient legs to surround a majority of the circumferential surface of said tubular drinking straw except for a minor portion sufficient to enable said drinking straw to slip therethrough;

the retaining collar member being of a diameter sufficient to receive and to substantially envelope an upper portion of the drinking straw when threaded through the collar member; wherein the retaining collar member cooperates with the drinking straw to hold the straw in a deformed condition when the pull tab is not separated from the container top portion and causes automatic emergence of the drinking straw when the pull tab is separated from said container top portion.

In one embodied form, the straw is held internally within the container by means of a retaining collar member secured to the underside of the pull tab to hold the flexible resilient straw in a deformed condition when the pull tab is unopened. In a preferred embodied form, the resilient force of the straw is complementary with the retaining force exerted by the collar member such that when the pull tab is separated from the container, the straw slips through a radial slot disposed on the collar member to emerge in a free standing fashion within the drinking opening defined by the separated pull tab.

Preferably, the straw is constructed from a compliant, resilient, plastic material and comprises an upper corrugated portion to permit prescribed resiliency and adjustment of length when the straw is internally positioned within the container.

Accordingly, the present system provides a unique packaging system for beverages such as sodas, juices, soft drinks and the like, enhancing hygienic and safety features of beverage containers, yet conveniently fabricated at a relatively modest production cost.

DESCRIPTION OF THE PREFERRED EMBODIMENTS

The present invention provides an improved packaging system for beverages, the system comprising a beverage container having an integral straw permitting automatic emergence of the straw when a pull tab is separated from the container. In one embodied form, the flexible, resilient straw is held internally within the container by a retaining collar member which is suitably secured to the underside of the pull tab to hold the straw in a deformed condition when the pull tab is not separated from the container. Accordingly, the unique convenient packaging system of the present invention enhances safety and hygienic features of beverage containers of the pull tab type at a relatively modest production cost.

Figure 1:
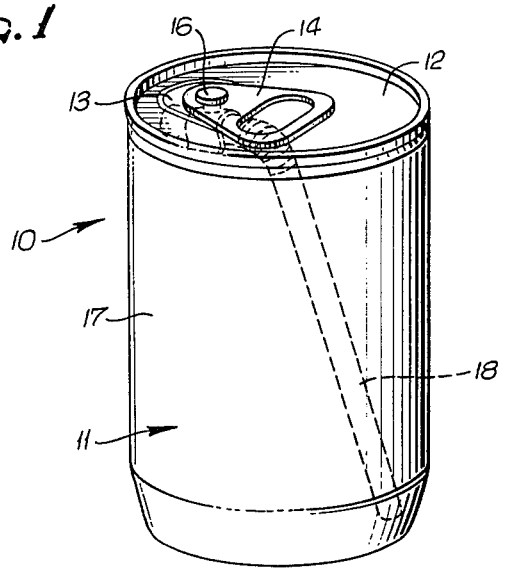
FIG. 1 is a perspective view of an improved beverage container with an integral drinking straw in accordance with one embodied form of the present invention.
Figure 2:
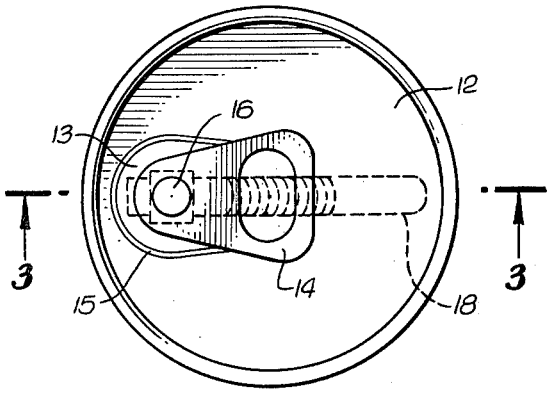
FIG. 2 is a top elevational view of the inventive beverage container depicted in FIG. 1.

Referring now to the drawing, denoted FIG. 1, there is shown one embodied form of the inventive packaging system, generally denoted 10, in accordance with the present invention. The beverage container 11 comprises at a top portion 12, a pull tab 13 and a pull ring 14 to gain access to the container contents. As shown, the ring 14 is typically pulled to separate the tab 13 from the container top portion 12 along a weakened seam 15. (FIG. 2) Anchoring means such as a rivot 16, is included to join the pull tab 13 and pull ring 14 together.

Typically, the container 11 is composed of an aluminum alloy, although other materials such as plastics are also suitable. Conventional manufacturing techniques produce the container top 12 as a separate major portion from the container body 17 and the two components are subsequently joined by crimping excess material **12*a* of the container top portion 12 to the uppermost rim of the container body 17**.

Figure 3:
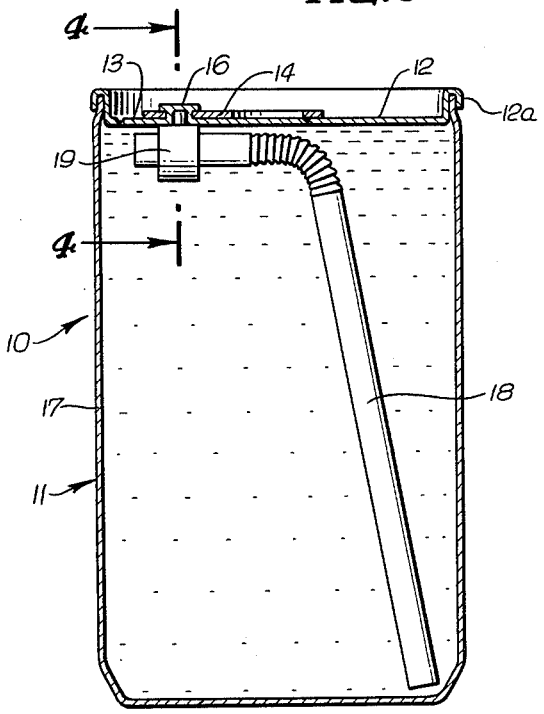
FIG. 3 is a cross-sectional view of the inventive beverage container depicted in FIG. 1, taken substantially along the line 3—3 of FIG. 2.

In accordance with the present invention as shown more clearly in FIG. 3, the unique system 10 comprises a flexible, resilient straw 18, typically composed of plastic, disposed within the container body 17 and associated with the pull tab 13 of the container 11 to permit automatic emergence of the straw 18 from the container 11 when the pull tab 13 is separated therefrom. In one embodied form, the straw 18 is held internally within the container by means of a retaining collar member 19, including a radial slot 20 as seen in FIG. 4.

Figure 4:
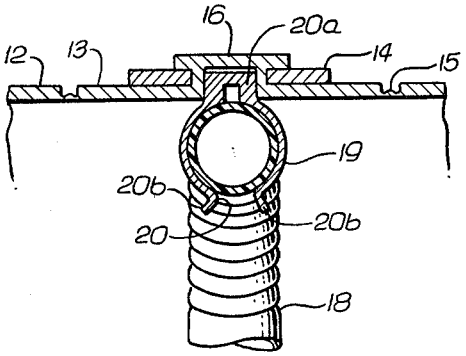
FIG. 4 is an enlarged cross-sectional view of the upper portion of the inventive beverage container depicted in FIG. 1, taken substantially along the line 4—4 of FIG. 3 illustrating suitable positioning of the straw within a retaining collar member when the beverage container is unopened.

As shown in FIG. 4, the retaining collar member 19 may further comprise means for effecting joinder with the rivet 16. Preferably joinder means such as a cooperative aperture is provided at a top collar portion **20*a* to suitably integrate with the pull ring 14 and pull tab 13 and common rivet 16. The collar member 19 preferably includes flaired end portions 20*b* and is of appropriate diameter (slightly larger than the outside diameter of the drinking straw 18 to be held), such that the flexible, resilient straw 18 is suitably positioned in a deformed condition within the container 17 when the pull tab 13** is unopened.

Figure 5:
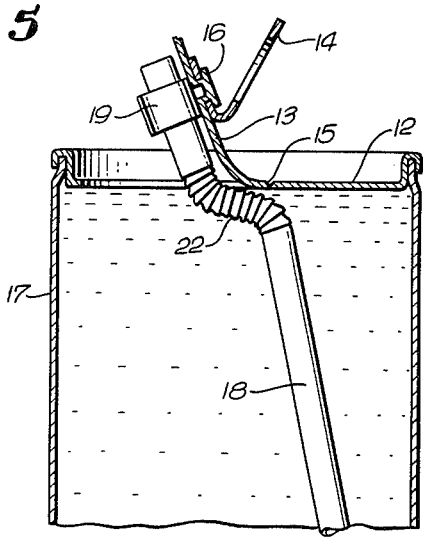
FIG. 5 is a further enlarged cross-sectional view of the beverage container depicted in FIG. 1 illustrating a pull tab in opened condition causing the upper portion of the straw to automatically emerge from the drinking opening in accordance with one embodied form of the present invention.
Figure 6:
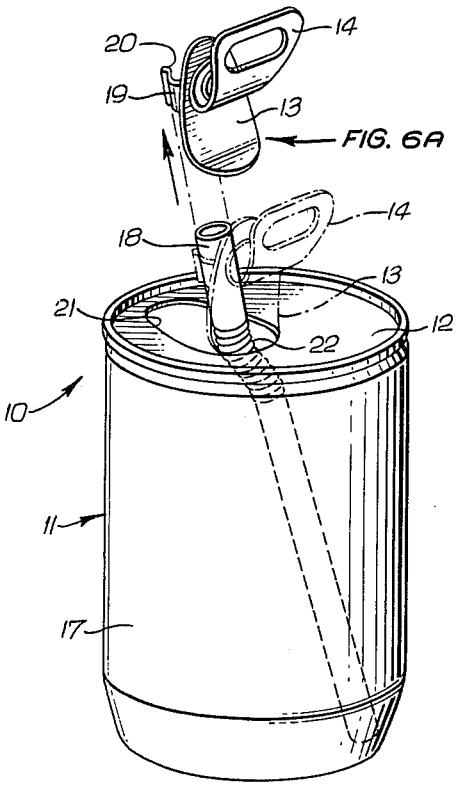
FIG. 6 is another perspective view of one embodied form of the inventive beverage container with pull ring, pull tab and retaining collar member removed from the container and drinking straw in an emerged condition.

Accordingly, FIG. 5 and FIG. 6 illustrates the pull tab 13 in an opened condition which causes automatic emergence of the upper portion of straw 18 through the drinking opening 21. Thereafter as seen in FIG. 6 the pull tab 13, pull ring 14 and collar 19 can be in one embodied form of the invention discarded by removal of the tab 13, ring 14, and the collar 19 from the container top portion 12 (generally FIG. 6*a*), or alternatively remain attached to the container top portion 12 (as shown in FIG. 6).

In a preferred embodied form, the resilient force of the drinking straw 18 is complimentary with the retaining force exerted by the collar member 20 such that when the pull tab 13 is opened but not removed entirely from the container portion 12, the drinking straw 18 slips through the radial slot 20 disposed on the collar member 19 to emerge in a free standing fashion within the drinking opening 21. In this regard, the resilient force exerted by the drinking straw 18 is comprised of several major factors: inherent resiliency of material used for construction; thickness of the drinking straw material; extent to which the drinking straw is deformed inside the beverage container prior to opening; and length of straw in excess of beverage container height. Likewise, the retaining force exerted by the collar member 19 is controlled by several major factors including: flexibility of material used for construction of collar member; width of radial slot 20; and extent to which the distal ends **20*b* of collar member 19 are flaired with respect to outside diameter of straw 18**.

With the foregoing factors in mind, those skilled in the art will readily recognize that the host of foregoing factors affecting the resilient force of the drinking straw 18 and retaining force exerted by the collar member 19 may be suitably varied such that the drinking straw 18 slips through the radial slot 20 disposed on the collar member 19 to emerge in a free standing fashion within the drinking opening 21 without having to completely remove the separated pull tab 13 from the container top 12.

Preferably, the drinking straw 18 further comprises an upper corrugated portion 22 to permit greater prescribed resiliency and adjustment of length when the straw 18 is internally positioned within the container 11. Moreover, such corrugation 22 insures that the original diameter of the straw 18 will be maintained even in a deformed condition when the pull tab 13 is unopened.

The retaining collar member 19 can be constructed from a vriety of suitable materials including aluminum, tin, plastics and the like.

Figure 7:
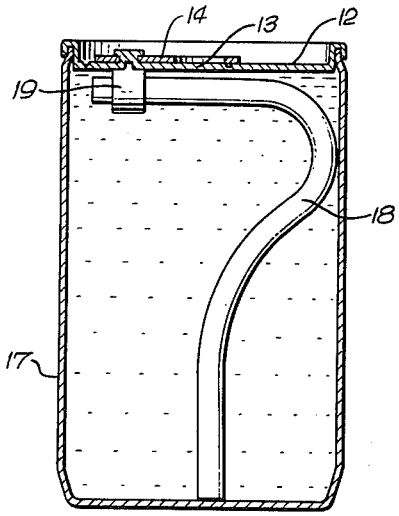
FIG. 7 is a cross-sectional view of the retaining collar member with associated beverage straw held within the collar member in accordance with an alternative embodied form of the present invention.

FIG. 7 depicts yet another embodiment of the inventive system wherein the straw 18 is not provided with corrugations.

Accordingly, the present invention provides a unique packaging system for beverage such as sodas, juices, soft drinks and the like, enhancing hygienic and safety features of beverage containers, yet conveniently fabricated at a relatively modest production cost.

Those skilled in the art will readily appreciate that the packaging system in accordance with the present invention, can be fabricated having a wide variety of specific component shapes to carry out the objects of the present invention. For instance, the pull ring 14 may be located and suitably anchored by rivet 16 to the portion of the pull tab 13 closest the midpoint of container top portion 12, rather than as seen most clearly in FIG. 2. Additionally, the shape of the pull tab 13 may be widened to form a larger drinking opening to suitably accommodate emergence of the straw 18 from the container top 12.

It will be apparent from the foregoing that, while particular forms of the invention have been illustrated and described, various modifications can be made without departing from the spirit and scope of the invention. Accordingly, it is not intended that the invention be limited, except by the appended claims.

I claim:

1. An improved packaging system for beverages, the system comprising a beverage container having, at a top portion, a pull tab and a pull ring; said pull tab and pull ring being joined by anchoring means; wherein when separated along the weakened seam said ring cooperates with said tab to produce a drinking opening in said container top portion;

an integral, flexible, resilient, tubular drinking straw disposed internally of said beverage container; and a resilient collar member disposed on the underside of said tab for holding said drinking straw in a deformed condition internally of said container when said pull tab is not separated from said container top portion;

said collar member comprising a top collar portion which is received and joined within a hollow disposed in the underside of said anchoring means, said collar member further comprising two resilient legs to surround a majority of the circumferential surface of said tubular drinking straw except for a minor portion sufficient to enable said drinking straw to slip therethrough;

said retaining collar member being of a diameter sufficient to receive and to substantially envelope an upper portion of said drinking straw when threaded through said collar member; wherein said retaining collar member cooperates with said drinking straw to hold said straw in a deformed condition when said pull tab is not separated from said container top portion and causes automatic emergence of said drinking straw when said pull tab is separated from said container top portion.

2. The improved packaging system as defined in claim 1 wherein said drinking straw comprises an upper corrugated portion.

3. The improved packaging system as defined in claim 1 wherein the resilient force of said drinking straw is complimentary with the retaining force exerted by the retaining collar member such that when said pull tab is separated from said container top portion, said drinking straw slips through said radial slot disposed on said collar member to emerge in a free-standing fashion in said drinking opening.

4. The improved packaging system as defined in claim 1 wherein said beverage container is fabricated from aluminum.

5. The improved packaging system as defined in claim 1 wherein said drinking straw is fabricated from plastic.

6. The improved packaging system as defined in claim 1 wherein said collar member is joined to said pull tab and said pull ring by a common rivet.

7. The improved packaging system as defined in claim 1 wherein said collar member is fabricated from aluminum.

* * * * *